US012358544B2

(12) United States Patent
Lohneis

(10) Patent No.: US 12,358,544 B2
(45) Date of Patent: Jul. 15, 2025

(54) ARRANGEMENT FOR THE TRANSMISSION OF PROCESS DATA

(71) Applicant: Siemens Mobility GmbH, Munich (DE)

(72) Inventor: Georg Lohneis, Ebensfeld (DE)

(73) Assignee: Siemens Mobility GmbH, Munich (DE)

( * ) Notice: Subject to any disclaimer, the term of this patent is extended or adjusted under 35 U.S.C. 154(b) by 0 days.

(21) Appl. No.: 18/841,458

(22) PCT Filed: Feb. 2, 2023

(86) PCT No.: PCT/EP2023/052527
§ 371 (c)(1),
(2) Date: Aug. 26, 2024

(87) PCT Pub. No.: WO2023/160979
PCT Pub. Date: Aug. 31, 2023

(65) Prior Publication Data

US 2025/0108845 A1 Apr. 3, 2025

(30) Foreign Application Priority Data

Feb. 24, 2022 (DE) ..... 10 2022 201 917.2

(51) Int. Cl.
*B61L 27/57* (2022.01)
*B61L 27/40* (2022.01)
*B61L 27/70* (2022.01)

(52) U.S. Cl.
CPC ..... *B61L 27/57* (2022.01); *B61L 27/40* (2022.01); *B61L 27/70* (2022.01)

(58) Field of Classification Search
CPC ..... B61L 27/57; B61L 27/40; B61L 27/70
See application file for complete search history.

(56) References Cited

U.S. PATENT DOCUMENTS

2018/0165532 A1* 6/2018 Menon Gopalakrishna ..... G06V 20/56
2019/0225246 A1* 7/2019 Garmson ..... B61L 15/0072
2019/0225247 A1* 7/2019 Garmson ..... B61L 23/08

FOREIGN PATENT DOCUMENTS

CN 101293529 A 10/2008

OTHER PUBLICATIONS

Anonymous: "EKE—Technology for smarter trains", Jun. 12, 2019 (Jun. 12, 2019), Seiten 1-68, XP055669843, URL:https://www.eke-electronics.com/images /eke/Brochure/EKE_Trainnet_.

(Continued)

*Primary Examiner* — Russell Frejd
(74) *Attorney, Agent, or Firm* — Laurence A. Greenberg; Werner H. Stemer; Ralph E. Locher

(57) ABSTRACT

An arrangement for transmitting process data between a rail vehicle and a track-side control entity. The rail vehicle has sensors, a controller, and a diagnostics server. Sensor measured values determined on the rail vehicle are transmitted to the controller as process data. The controller has a configurable data processing system to prepare process data of a selected sensor for transmission to the diagnostics server. The controller is connected to the diagnostics server via a configurable connection for the purpose of process data transmission. This connection has bus-linked transmission options, one of which can be selected depending on the configuration. The diagnostics server has a configurable data management section and a configurable data processing system. Read-in process data is processed on the basis of functions by these configurations. The process data processed in this way then reaches the trackside. The rail vehicle configurations can be adjusted from the trackside.

4 Claims, 3 Drawing Sheets

(56) References Cited

OTHER PUBLICATIONS

Siemens AG: "Sinamics S120 Kommunikation", Prior Art Publishing GMBH, Prior Art Publishing GMBH, Manfred-Von-Richthofen-Str. 9, 12101 Berlin Germany, Bd. www.priorartregister.com, Oct. 31, 2019 (Oct. 31, 2019), pp. 1-246, XP007022849.

* cited by examiner

ARRANGEMENT FOR THE TRANSMISSION OF PROCESS DATA

FIELD AND BACKGROUND OF THE INVENTION

The invention relates to an arrangement for transmitting process data between a rail vehicle and a static control point referred to as the track side.

It is known practice to transmit process data between the rail vehicle and the control point.

The process data are ascertained by the rail vehicle using sensors, for example, and are evaluated on the track side.

By way of example, the sensors are:

- incremental transmitters, provided for calculating the speed of the rail vehicle,
- sensors having analog inputs, used for recording voltages, currents or temperatures, etc., or
- sensors having digital inputs, used for recording switching cycles of components, etc.

The process data are ascertained, processed and transmitted by the rail vehicle using software provided for that purpose, which is the subject of software licensing.

A change in the process data to be transmitted necessitates a change in the software, which, on the basis of this, must again undergo relicensing, which is time-consuming and expensive. This relicensed software must then in turn be installed on associated rail vehicles, which is time-consuming and expensive.

SUMMARY OF THE INVENTION

It is therefore the object of the present invention to specify an arrangement for transmitting process data between a rail vehicle and a static control point that permits process data to change without requiring the applicable software to be re-licensed.

This object is achieved by the features as claimed. Advantageous developments are specified in the dependent patent claims.

The inventive arrangement for transmitting process data has a rail vehicle and a static control point referred to as the track side. For the purpose of transmitting process data from the rail vehicle to the track side, these are connected to one another.

The rail vehicle has sensors, a control unit and a diagnosis server. Each sensor is connected to the control unit, so that sensor measured values ascertained on the rail vehicle are transmitted to the control unit as process data.

The control unit has a configurable data processing section, the configuration resulting in process data of a selected sensor being collected, pre-processed and prepared for a transmission to the diagnosis server. The control unit is connected to the diagnosis server via a configurable connection that is used to transmit the process data from the control unit to the diagnosis server.

This configurable connection has a number of bus-oriented transmission options (Ethernet, CAN, MVB) from which, as a result of the configuration, a predetermined bus-oriented transmission is able to be selected in order to transmit the process data from the control unit to the diagnosis server.

The diagnosis server has a configurable data management section that is used by the diagnosis server to prepare read-in process data of the bus-oriented transmission for a function-based processing. For the function-based processing of the process data, the diagnosis server has a configurable data processing section that is connected to the data management section and that provides multiple selectable functions for the process data processing, from which, as a result of the configuration, a predetermined function is able to be selected.

The configurable data processing section is connected to the track side via a configurable connection in order to transmit the process data processed using the selectable function to the track side. The configurations on the rail vehicle are able to be adjusted from the track side.

In one advantageous development, the configurable connection between the control unit and the diagnosis server is designed for an Ethernet transmission, for a CAN transmission or for MVB transmission of the process data.

In one advantageous development, the configurable data processing section of the controller is able to adjust a value range normalization, a sampling time interval and/or a sensor selection for the process data provided by the sensors.

In one advantageous development, the track side is able to produce an additional function. The additional function is able to be implemented on the diagnosis server by way of the configurable data processing section thereof.

The present invention has the significant advantage over the prior art that properties and parameters of functions are able to be changed, or extended, on the rail vehicle during operation thereof without requiring requisite software to be relicensed.

The present invention permits the rail vehicle to be operated with additional or altered functions, even for a limited time.

The present invention has the further significant advantage that process data are able to be changed, or extended, on the rail vehicle during operation thereof without requiring requisite software to be relicensed.

The present invention permits later installation, or extension, of a sensor system provided on the rail vehicle.

The present invention therefore permits a fast reaction to demands from fleet management, from engineering and to changes in the system layout of the rail vehicle.

The present invention permits adaptable troubleshooting for the rail vehicle, or adaptable evaluation of fleet data, or of data of the rail vehicle.

The invention is explained more thoroughly by way of illustration hereinbelow with reference to a drawing, in which:

DETAILED DESCRIPTION OF THE INVENTION

Figure 1:
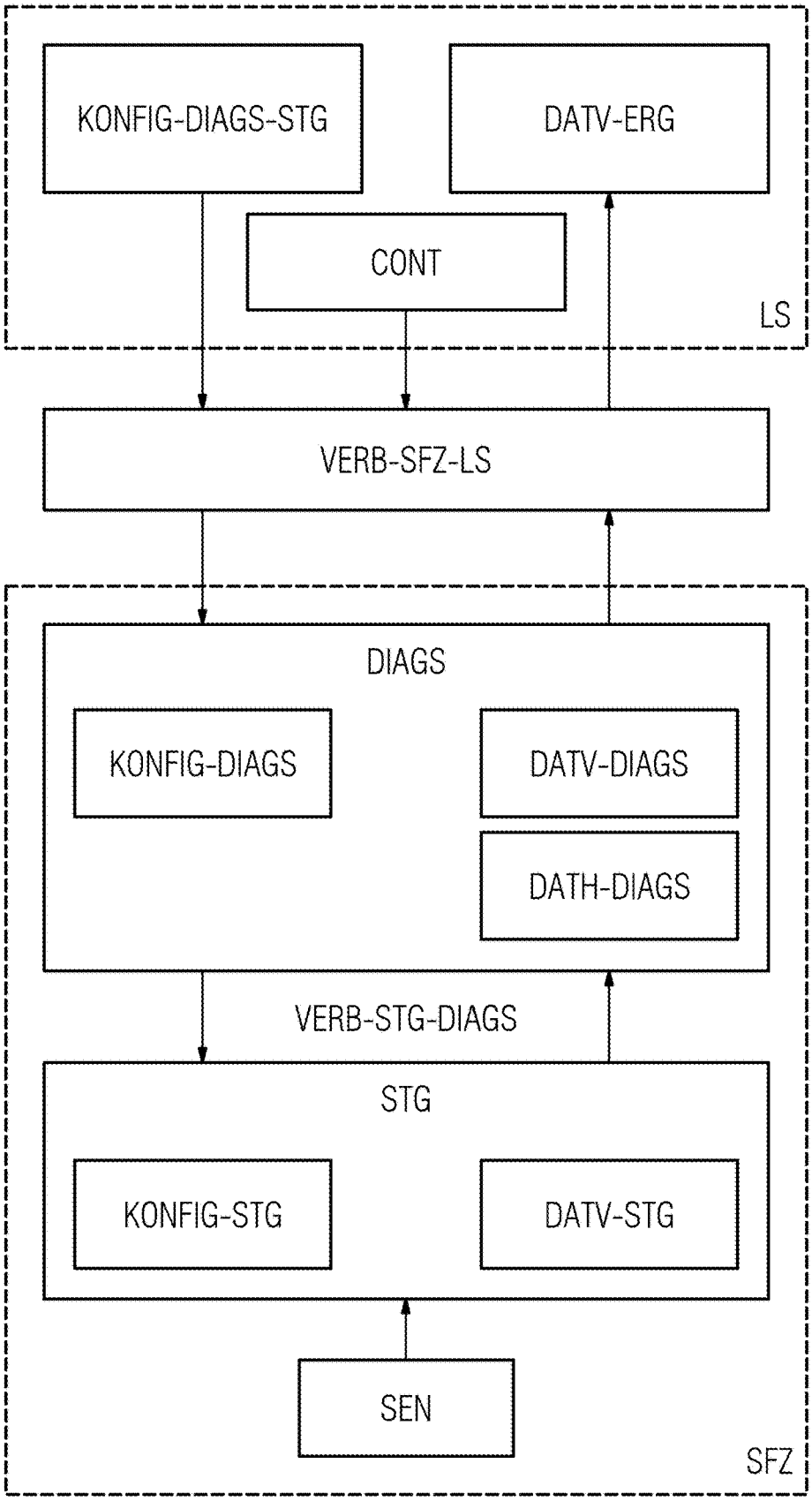
FIG. 1 shows an overview of the present invention.

FIG. 1 shows an overview of the present invention in which selected elements, described hereinbelow, are configurable for the process data transmission.

According to the invention, the configuration permits even process data that are transmitted in the course of operation of a rail vehicle SFZ to be transmitted to a track side LS in altered, complemented and possibly (pre-) processed form.

The rail vehicle SFZ has a sensor SEN, a control unit STG and a diagnosis server DIAGS.

The sensor SEN is used to record, or ascertain, measured values as process data and to transfer them to the control unit STG.

The control unit STG is responsible for collecting process data from multiple sensors and manipulating them, possibly for further use, in advance.

For this purpose, the control unit STG has a data-processing section DATV-STG that is able to be changed by way of a configuration section KONFIG-STG.

The control unit STG is connected to the diagnosis server DIAGS via a configurable connection VERB-STG-DIAGS. This configurable connection VERB-STG-DIAGS is used to modifiably forward the process data from the control unit STG to the diagnosis server DIAGS.

The diagnosis server DIAGS is responsible for collecting, storing and processing transmitted process data and for providing the result of this processing for the transmission to the track side LS, or preparing said result for this transmission.

For this purpose, the diagnosis server DIAGS has a data-processing section DATV-DIAGS and a data management section DATH-DIAGS, both of which are able to be configured by the diagnosis server DIAGS by way of a configuration section KONFIG-DIAGS.

The diagnosis server DIAGS, or the rail vehicle SFZ, is connected to the track side LS, which provides functionalities of a static control point, via a configurable connection VERB-SFZ-LS.

The track side LS has a result data processing section DATV-ERG that is used to process the process data transmitted by the rail vehicle SFZ, or that is used to process the process data transmitted by the diagnosis server DIAGS.

The result data processing section DATV-ERG performs the evaluation of the process data, this comprising displaying a process image or calculating maintenance requirements of components, for example. Other uses are troubleshooting based on the process data or long-term evaluation of the process data.

In summary, the present invention involves the track side LS being used to configure:

- the data processing section DATV-STG of the control unit STG,
- the connection VERB-STG-DIAGS between the control unit STG and the diagnosis server DIAGS,
- the data processing section DATV-DIAGS and the data management section DATH-DIAGS of the diagnosis server DIAGS,
- the connection VERB-SFZ-LS between the rail vehicle SFZ, or between the data-processing section DATV-DIAGS, and the track side LS.

For this configuration, the track side LS has a configuration unit KONFIG-DIAGS-STG that produces, or holds, configuration instructions for the cited elements, which are then transmitted from the track side LS to the cited elements for implementation therein.

In order to transmit new functions from the track side LS to the rail vehicle SFZ for implementation therein in associated elements, a so-called container CONT is used. Said container is formed on the track side and transmitted to the rail vehicle SFZ, or to the elements thereof. This is described more thoroughly with the aid of the figures that follow.

Figure 2:
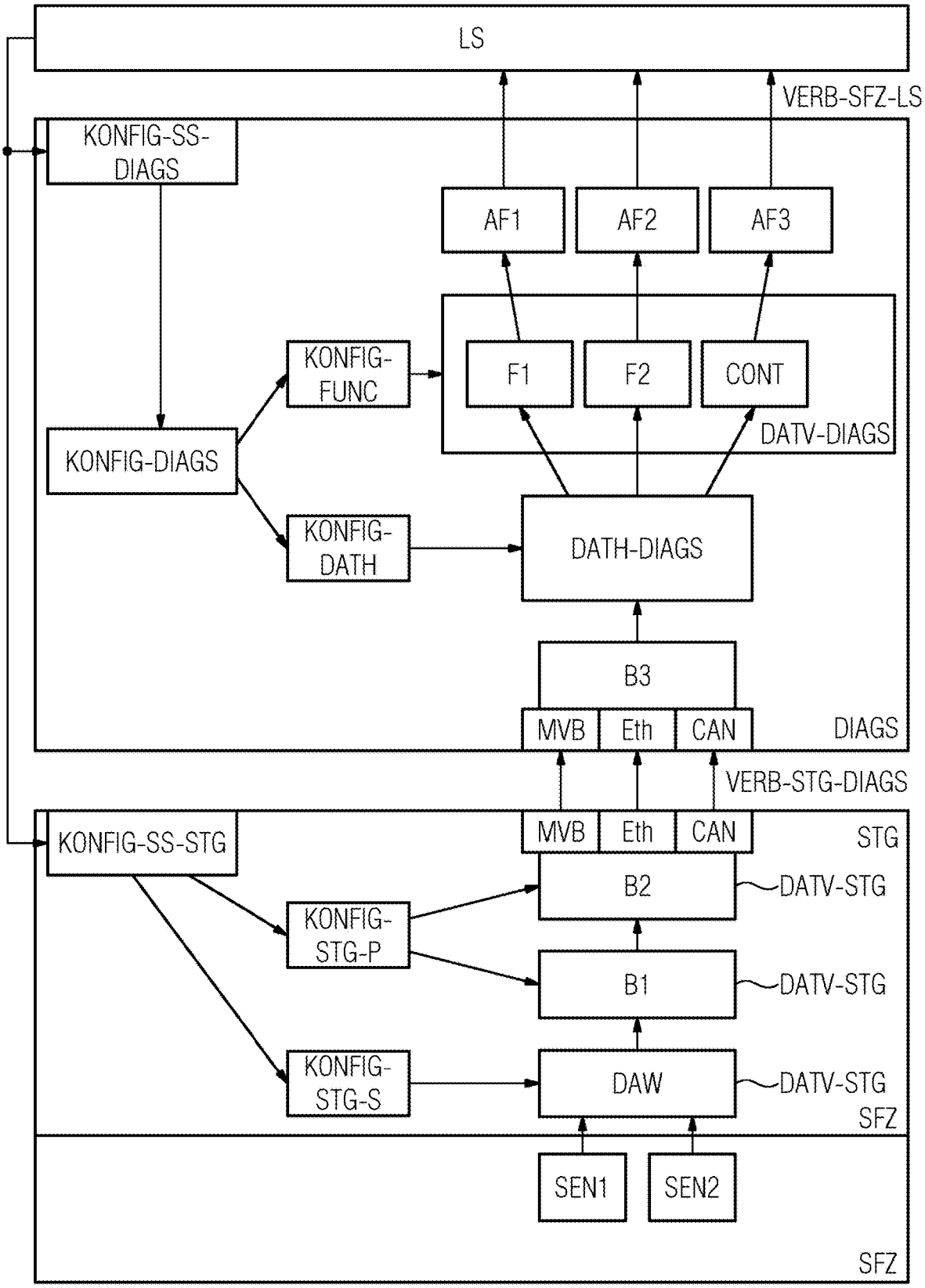
FIG. 2 shows a more detailed further illustration of the present invention with reference to FIG. 1.

FIG. 2 shows a more detailed illustration of the present invention with reference to FIG. 1.

The sensor SEN from FIG. 1 is in the form of an analog sensor SEN1 and in the form of a digital sensor SEN2 here. Both sensors SEN1, SEN2 capture and transmit measurement data to the controller STG of the rail vehicle SFZ as process data.

The sensors SEN1, SEN2 record the speed of the rail vehicle SFZ, for example, or record temperatures of components of the rail vehicle SFZ, etc.

The process data are conveyed, for example via a digital-to-analog converter DAW, to a configurable unit B1 that normalizes measured values of the sensors and provides said measured values for an output interface B2 as process data of one data type. The configuration is used to adjust the normalization and/or the data type to be used, for example.

The output interface B2 is configurable and prepares the process data for a transmission to an interface B3, which is part of the diagnosis server DIAGS, via the connection VERB-STG-DIAGS.

By way of illustration, the two interfaces B2, B3 use one of three transmission methods provided for that purpose:

- transmission via the known Ethernet bus Eth, or
- transmission via the known CAN bus, CAN standing for "Controller Area Network" and describing a serial bus system, or
- transmission via the "Multifunction Vehicle Bus", referred to as MVB for short, which is known from railway engineering.

The process values are converted into a machine-readable format for the transmission taking place from the control unit STG to the diagnosis server DIAGS via the interface VERB-STG-DIAGS and, following transmission, are made available to the diagnosis server DIAGS for further processing.

For the transmission taking place via the interface VERB-STG-DIAGS, it is stipulated which physical interface (Eth, CAN, MVB) is used to transmit the process values. At the same time, the content of the associated data transmission telegram is stipulated.

The digital-to-analog converter DAW, the unit B1 and the output interface B2 form the configurable data processing section DATV-STG of the control unit STG that was described in figure FIG. 1. These are able to be configured by way of a configuration interface KONFIG-SS-STG of the control unit STG.

As described hereinabove, the configuration interface KONFIG-SS-STG of the control unit STG receives instructions for configuration via the track side LS.

A unit KONFIG-STG-P connected to the configuration interface KONFIG-SS-STG is used to configure the unit B1 and the output interface B2.

A unit KONFIG-STG-S connected to the configuration interface KONFIG-SS-STG is used to configure the sensor system of the digital-to-analog converter DAW.

The connection of the two sensors SEN1, SEN2 to the digital-to-analog converter DAW and also the characteristic, or mode of operation, of the elements DAW, B1, B2 of the data processing section DATV-STG are stipulated by way of the cited configuration units KONFIG-STG-P and KONFIG-STG-S.

By way of example, a value range normalization, a sampling time interval, etc., is adjusted for the process data provided by the sensors. Which sensor values are transmitted to the diagnosis server DIAGS as process values is also stipulated.

This allows properties of the sensor system formed by the sensors SEN1, SEN2 to be changed, or adapted, on the rail vehicle in the course of operation thereof.

Later modification of the sensor system in the rail vehicle is also enabled without the software used for process data processing on the rail vehicle needing to be changed, or relicensed.

There is provision in the diagnosis server for a further configuration interface KONFIG-SS-DIAGS, which receives its instructions for configuration via the track side LS and transmits them to a unit KONFIG-DIAGS.

A unit KONFIG-FUNC connected to the unit KONFIG-DIAGS is used to configure functions F1, F2, or the container CONT, which provides an additional function.

The functions F1, F2, or the container CONT, form the data processing section DATV-DIAGS of the diagnosis server DIAGS that was described in figure FIG. 1.

A unit KONFIG-DATH connected to the unit KONFIG-DIAGS is used to configure the process values of the data management section DATH-DIAGS.

Using the unit KONFIG-DATH, the data management section DATH-DIAGS stipulates which process data are read and processed by which transmission method (Eth, CAN, MVB).

These selected process values are then made available, in the data management section DATH-DIAGS of the diagnosis server DIAGS, to the associated functions F1, F2, or the function of the container CONT.

A scenario for the functions F1, F2 and CONT that are performed is described by way of illustration hereinbelow:

The properties of the functions F1 and F2 differ in their basic characteristic, for example are both in the form of cyclic recording functions or in the form of a histogram function.

The result of the functions F1, F2 is stored as a respective file in a respective file system AF1, AF2 and transmitted to the track side LS by way of the latter.

If not all of the basic properties of requisite functions are yet known when the software for the diagnosis server DIAGS is produced, an additional function is provided in the container CONT by the track side LS, and transmitted to the diagnosis server DIAGS, during operation of the rail vehicle.

If the diagnosis server DIAGS is restarted, the function that the container CONT contains is activated by the diagnosis server DIAGS and performed as an additional function. The result of this function is stored as a file in a file system AF3 and then transmitted to the track side LS.

The files of the file systems AF1, AF2, AF3 are transmitted by way of the interface VERB-SFZ-LS known from figure FIG. 1.

The configuration instructions provided by the track side LS are preferably transmitted from the track side LS to the rail vehicle SFZ in radio-based fashion—that is to say that the interfaces KONFIG-SS-DIAGS and KONFIG-SS-STG are designed to carry out the radio-based transmission in this case.

Figure 3:
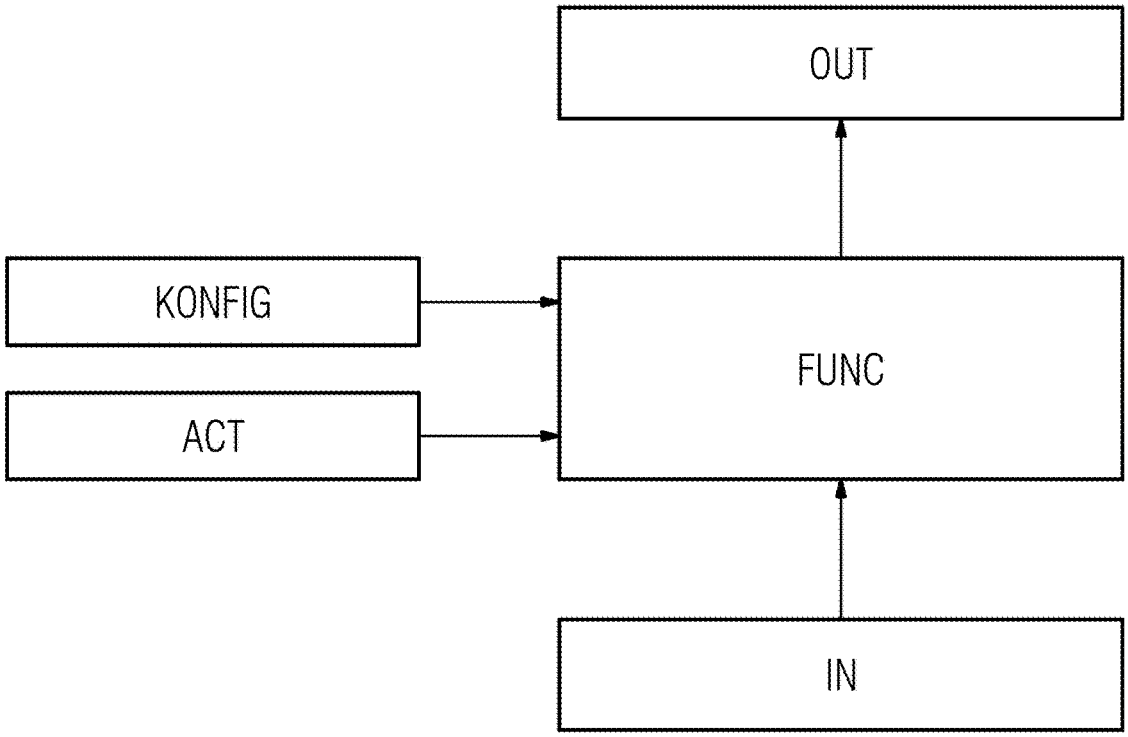
FIG. 3 shows a representation of the so-called "container" with reference to figures FIG. 1 and FIG. 2.

FIG. 3 shows a representation for the container CONT with reference to figures FIG. 1 and FIG. 2.

To make the behavior of the functions F1, F2, or CONT, configurable, said functions have the following structure:

Each function has a configurable input interface IN and a configurable output interface OUT.

The configurable input interface IN is used to convey process data for manipulation to the respective function.

The configurable output interface OUT is used to provide process data from the respective function for a subsequent, further processing.

A configuration interface KONFIG is used by the function to receive the necessary configuration instructions for the process data, or requisite parameters, to be processed.

The configuration interface KONFIG is also used to configure the two interfaces IN and OUT.

An action interface ACT is used to control the operational behavior of the function. Possible action commands are for example "start the function", "adopt a new configuration", "terminate the function", etc.

The invention claimed is:

1. An arrangement for transmitting process data, the arrangement comprising:

a rail vehicle and a track-side static control point connected to one another for transmitting process data from the rail vehicle to said track-side;

said rail vehicle having sensors, a control unit, and a diagnosis server;

each of said sensors being connected to said control unit and configured to transmit sensor measured values ascertained on said rail vehicle to the control unit as process data;

said control unit having a configurable data processing section, wherein process data of a selected sensor are collected, pre-processed, and prepared for a transmission to said diagnosis server;

said control unit being connected to said diagnosis server via a configurable connection that is used to transmit the process data from said control unit to said diagnosis server;

said configurable connection having a plurality of bus-oriented transmission options from which, by a configuration thereof, a predetermined bus-oriented transmission may be selected in order to transmit the process data from said control unit to said diagnosis server;

said diagnosis server having a configurable data management section used by said diagnosis server to prepare read-in process data of the predetermined bus-oriented transmission for a function-based processing;

wherein, for a function-based processing of the process data, said diagnosis server has a configurable data processing section connected to said data management section and configured to provide multiple selectable functions for the processing of the process data, from which, as a result of a configuration thereof, a predetermined function may be selected;

wherein said configurable data processing section is connected to said track side via a configurable connection in order to transmit the process data processed with the selectable function to said track side; and wherein the configuration of the configurable connection on the rail vehicle is adjustable from said track side.

2. The arrangement according to claim 1, wherein the configurable connection between said control unit and said diagnosis server is configured for a transmission of the process data via one of an Ethernet transmission, a CAN transmission, or a MVB transmission.

3. The arrangement according to claim 1, wherein said configurable data processing section of said controller is configured to adjust at least one of a value range normalization, a sampling time interval, or a sensor selection for the process data provided by said sensors.

4. The arrangement according to claim 1, wherein:

the track side is configured to produce an additional function; and said configurable data processing section of said diagnosis server is configured for implementing the additional function on said diagnosis server.

* * * * *